US005894956A

United States Patent [19]

Keith

[11] Patent Number: 5,894,956

[45] Date of Patent: Apr. 20, 1999

[54] REPLACEMENT CAULKING TIP

[76] Inventor: Christopher A. Keith, 57 Via Hermosa, San Lorenzo, Calif. 94580

[21] Appl. No.: 08/800,272

[22] Filed: Feb. 13, 1997

[51] Int. Cl.[6] ..... B67B 7/00

[52] U.S. Cl. ..... 222/91; 222/568; 222/1

[58] Field of Search ..... 222/91, 568, 570, 222/1

[56] References Cited

U.S. PATENT DOCUMENTS

| | | | |
|---|---|---|---|
| 1,865,484 | 2/1932 | Roos . | |
| 3,278,083 | 10/1966 | Serafini . | |
| 3,549,049 | 12/1970 | Weber . | |
| 4,712,714 | 12/1987 | Mucciarone . | |
| 4,826,500 | 5/1989 | Rautsola . | |
| 4,957,225 | 9/1990 | Childers | 222/568 |
| 5,104,013 | 4/1992 | Hawley | 222/568 X |
| 5,249,716 | 10/1993 | O'Sullivan | 222/568 |
| 5,295,601 | 3/1994 | Bostleman . | |
| 5,346,380 | 9/1994 | Ables | 222/568 X |

*Primary Examiner*—Gregory L. Huson
*Attorney, Agent, or Firm*—Harris Zimmerman

[57] ABSTRACT

A disposable replacement tip for caulking tubes includes a conical first end portion tapered acutely to a distal sharpened point. The exterior of the first end portion is provided with threads, and an intake port adjacent to the sharp point extends diametrically through the tubular member. Joined to the wide end of the first end portion is a generally cylindrical, tubular central portion. A second end portion extends from the central portion in opposition to the first end portion, both end portions being aligned along a common axis. The second end portion comprises another conical tubular member tapered acutely to an open end. A continuous flow space extends from the intake port, through the interiors of the first end portion, the central portion, and the second end portion to the open end thereof. The sharpened point of the first end portion may be driven into the end opening of a caulking tube, or through the sidewall of the tube, and the device is rotated manually. The external threads of the first end portion are self-tapping and self sealing, so that the first end portion is urged proximally, piercing the blockage at the distal end opening and translating the intake port into the caulking tube to access the unsolidified, flowable material therein. All flowable material within the caulking tube is directed into the intake port and thence through the device to the opening of the second end portion, whereby all usable material within the caulking tube is discharged.

10 Claims, 2 Drawing Sheets

REPLACEMENT CAULKING TIP

BACKGROUND OF THE INVENTION

The present invention generally relates to caulking tubes, and more particularly to a replacement caulking tip that enables full use of the contents of a caulking tube.

A great many construction materials are packaged in caulking tubes, in addition to caulking compounds themselves. Such substances as adhesives, sealants, roof patching material, wood and plastic filler, and the like are typically packaged in caulking tubes. The ubiquitous caulking gun makes possible the use of products thus packaged, and enables the careful and accurate dispensation of these substances.

It frequently occurs that the contents of a caulking tube are not used completely, leaving the tube partially filled. Typically, the partially filled tube is saved for future use, and stored for a period of time. The contents in the dispensing end of the tube, and particularly the dispensing nozzle, are exposed to ambient air, and will harden, dry, or cure to a state in which the material cannot flow. Thereafter, it is extremely difficult to gain access to the remaining contents of the tube, due to the blockage of the solidified material in the nozzle tip. Although it may be possible to open a new dispensing passage by inserting a nail or pin into and through the solidified material, this expedient often fails or disrupts the smooth delivery of the material, resulting in poor bead formation. Typically, the partially filled tube is discarded, and the still-usable material found therewithin is wasted.

SUMMARY OF THE PRESENT INVENTION

The present invention generally comprises a disposable replacement tip for caulking tubes and the like. A salient feature of the invention is that is makes possible the use and dispensation of material in partially filled caulking tubes that would otherwise be unavailable and wasted.

The replacement tip of the invention includes a first end portion comprising a conical tubular member tapered acutely to a distal sharpened point. The exterior of the first end portion is provided with threads that taper in accordance with the conical tubular member. An intake port extends diametrically through the tubular member, communicating with the hollow interior of the tubular member. The intake port is disposed closely adjacent and spaced apart with respect to the sharpened point.

Joined to the wide end of the first portion is a generally cylindrical, tubular central portion. The central portion is ribbed or knurled to provide a good manual frictional grip. A second end portion extends from the central portion in opposition to the first end portion, both end portions being aligned along a common axis. The second end portion comprises another conical tubular member tapered acutely to a closed end that is adapted to be severed at any selected point therealong to form an open dispensing end. The exterior of the second end portion is generally smooth.

A continuous flow space extends from the intake port, through the interiors of the first end portion, the central portion, and the second end portion to the open end thereof.

The first end portion is generally employed to connect the device to a caulking tube or the like, whereby the flowable material within the caulking tube may be tapped and utilized, even though the existing tip of the caulking tube may be clogged, blocked, broken, or entirely absent. For example, if the caulking tube dispensing tip is blocked by solidified material, the dispensing tip may be cut off of the caulking tube to define a distal end opening to the caulking tube. The sharpened point of the first end portion is then driven into the distal end opening, and the device is rotated manually. The external threads of the first end portion are self-tapping, so that the first end portion is urged proximally, piercing the blockage at the distal end opening and translating the intake port into the caulking tube to access the unsolidified, flowable material therein. At the same time, the threaded engagement forms a seal with the distal end opening, whereby all flowable material within the caulking tube is directed into the intake port and thence through the device to the opening of the second end portion. The tapered diameter of the threaded end is capable of engagement with a wide range of caulking tube tips.

As another example of the use of the device, situations may arise in which it is not possible to drive the device into the dispensing tip or distal opening of the caulking tube. In this circumstance, the sharpened tip of the first end portion may be driven into the sidewall of the caulking tube, piercing the sidewall. The device is then rotated manually to cause the threads to advance the first end portion into the interior of the caulking tube, thereby translating the intake port into communication with the flowable material within the caulking tube. The threaded engagement forms a seal with the sidewall, so that all of the flowable material is directed through the device to the end opening of the second end portion.

In either example, after the device is installed, a caulking gun or the like may be employed to exert pressure on the flowable material, as is known in the prior art, whereby the flowable material is driven to flow through the device and out of the end opening of the second end portion. As a result, the flowable material may be discharged from the device in a smooth bead, as is desirable for many constructions and assembly tasks. It may be appreciated that the second end portion may be cut off at any selected point between the end opening thereof and the central portion, so that the discharge opening of the device may be enlarged to determine the desired bead size of the flowable material as it is discharged through the device.

The device of the invention may be fabricated from molded polymer plastic or the like, whereby the device is inexpensive to manufacture. When the use of the device is completed, it may be discarded, although it may be reused if convenient.

DESCRIPTION OF THE PREFERRED EMBODIMENT

The present invention generally comprises a replacement dispensing tip for caulking tubes and similar cartridges of viscous, flowable substances adapted for discharge through a dispensing tip.

Figure 1:
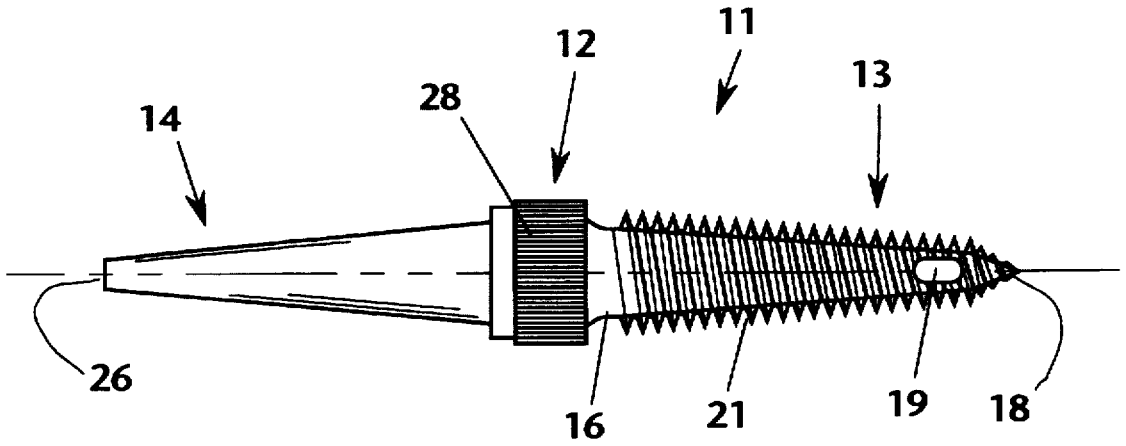
FIG. 1 is a plan view of the replacement caulking tip of the present invention.
Figure 2:
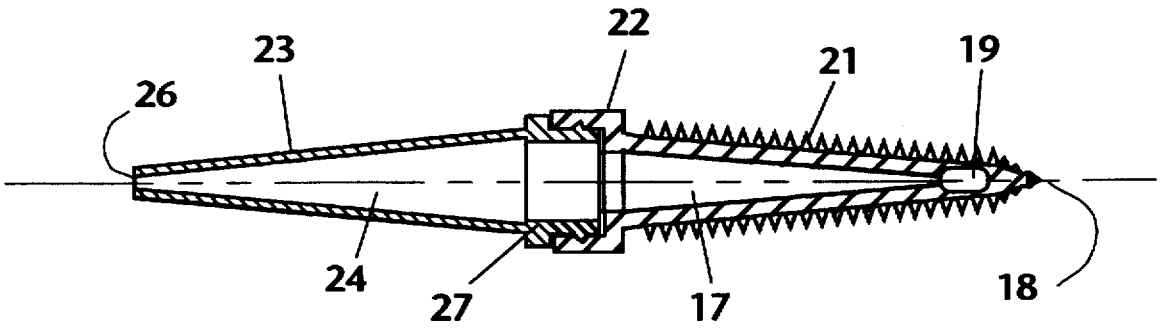
FIG. 2 is a cross-sectional plan view of the replacement caulking tip of the present invention.

With regard to FIGS. 1 and 2, the invention comprises a replacement tip 11 having a central portion 12, a first end portion 13, and a second end portion 14, all aligned along a common central axis. The end portion 13 comprises a conical tubular member 16 having an interior bore 17. The end portion 13 tapers acutely to a sharpened end 18, and an intake port 19 extends diametrically through the end portion 13 adjacent to and spaced apart from the sharpened end 18, so that the intake port 19 is in flow communication with the interior bore 17. The end portion 13 is provided with threads that follow the tapered conformation of the exterior surface. At the wide end of the end portion 13, a cup-shaped cylindrical member 22 is formed in integral fashion, defining a component of the central portion 12.

The end portion 14 is comprised of a conical tubular member 23 having a smooth outer surface and an interior bore 24. The end portion tapers acutely to a discharge opening 26. At the wide end of the end portion 14, a cup-shaped cylindrical member 27 is formed integrally and dimensioned to be snap-engaged in the portion 22, whereby the two end portions 13 and 14 are permanently joined at the central portion 12. The exterior surface 28 of the portion 22 is ribbed or knurled to enhance frictional manual grip. It may be appreciated that a continuous flow path extends from the intake port 19 through the interior bores 17 and 24 to the discharge opening 26.

Figure 3:
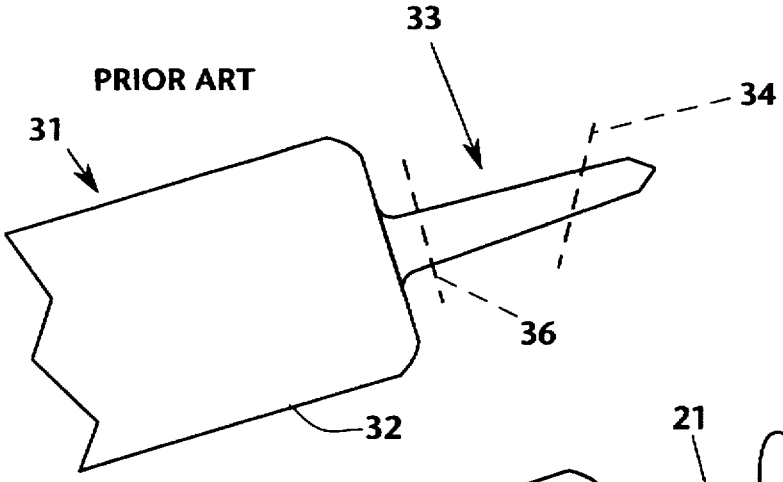
FIG. 3 is a plan view of the dispensing end of a typical caulking tube known in the prior art.

With regard to FIG. 3, a typical prior art caulking tube 31 comprises a cylindrical cartridge 32 having a dispensing tip 33 extending coaxially from one end thereof. The tip 33 is typically cut off at a selected point along its length, as shown by reference numeral 34, so that the material discharged from the tip 33 forms the desired bead size. After use, material remaining in the tip 33 solidifies and blocks the discharge path of the tip, while a substantial amount of flowable material may remain inaccessible within the tube 31.

Figure 4:
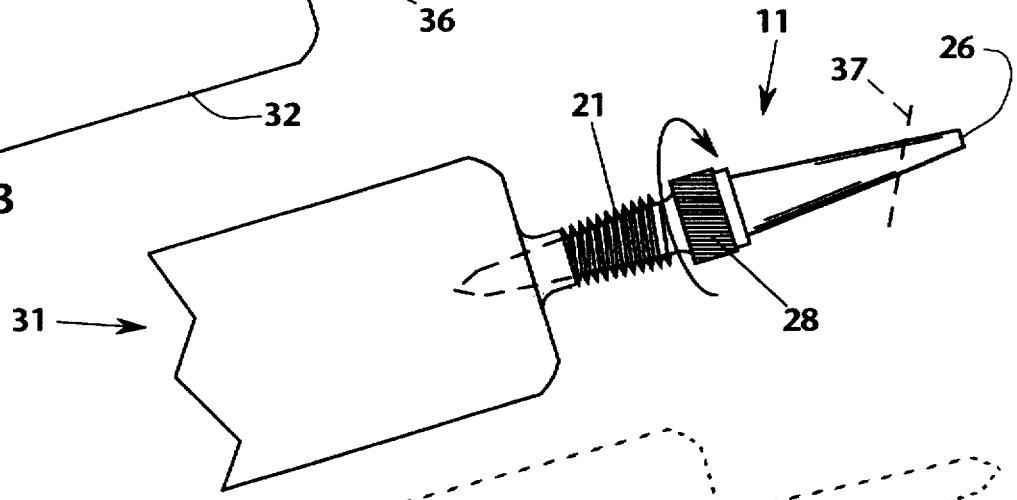
FIG. 4 is a plan view depicting the replacement caulking tip of the present invention installed in the dispensing tip of a typical caulking tube.

To employ the device 11 of the invention, the tip 33 of a previously used cartridge is cut off adjacent to the cartridge, as shown by reference numeral 36. The sharp end 18 of the device 11 is then inserted into the tip opening at 36 (FIG. 4), and the device is rotated manually, using the ribbed surface 28 of central portion 12, to engage the threads 21 in the tip opening. The threads are self-tapping and self-sealing in engaging the tip, whereby the device advances into the cartridge and the sharp end 18 pierces the blockage, if any, formed by solidified material in the tip and adjacent portion of the cartridge 32. The intake port is thus translated into contact with the flowable material remaining in the tube 31. Thereafter, the tube 31 may be employed in conjunction with a typical caulking gun or the like, and the flowable material within the tube 31 may be discharged through the flow path of the device 11 in the same manner as if the original tip 33 were in use. Indeed, the end portion 14 may be cut off at any desired location, as shown by reference numeral 37, to control the bead size of the discharge. In this manner the entire usable contents of the caulking tube 31 may be used, and the waste of material known in the prior art is eliminated.

Figure 5:
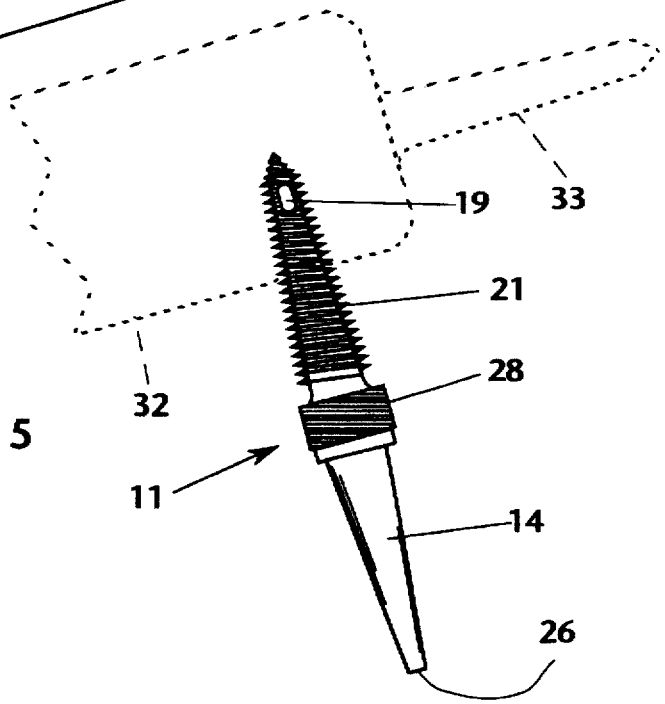
FIG. 5 is a plan view depicting the replacement caulking tip of the present invention installed in the sidewall of a typical caulking tube.

Alternatively, the device 11 may be installed directly into the sidewall of a used cartridge 32, as shown in FIG. 5. The sharp tip 18 may be manually driven into the sidewall, piercing it, and the device is then rotated to engage the threads 21 and advance the portion 13 into the interior of the cartridge. The intake port 19 is translated into communication with the flowable material within the caulking tube. The threaded engagement forms a seal with the sidewall, so that all of the flowable material is directed through the device 11 to the end opening 26. Thereafter, the tube 31 may be employed in conjunction with a typical caulking gun or the like, and the flowable material within the tube 31 may be discharged through the flow path of the device 11. This alternative use may be selected when the existing caulking tube tip is not accessible, or when discharge at a substantial angle to the axis of the caulking gun and the existing tip is preferred.

The device 11 of the invention may be fabricated from molded polymer plastic or the like, whereby the device is inexpensive to manufacture. The use of this material permits the end portion 14 easily to be cut off, as described above, to control the bead size of the material as it is discharged. When the use of the device is completed, it may be discarded, although it may be reused if convenient.

It should be noted that the tapered, threaded construction of the end portion 13 not only provides a self-tapping, self-sealing engagement with the caulking tube, it also enables the device to be used with a wide range of caulking tube tip sizes.

I claim:

1. A replacement dispensing tip for a caulking tube having a blocked outlet end, including:

a first end portion having a sharp point adapted to pierce the blockage in the outlet end;

external thread means on said first end portion for engaging the outlet end and driving said sharp point through the blockage;

an intake port extending through said first end portion adjacent to said sharp point to access flowable material disposed within the caulking tube;

a second end portion extending in opposition to said first end portion and including a discharge opening; and, a flow path extending from said intake portion through said first and second end portions to said discharge opening to permit discharge of the flowable material disposed within the caulking tube.

2. The replacement dispensing tip of claim 1, wherein said intake port extends diametrically through said first end portion.

3. The replacement dispensing tip of claim 1, wherein said first end portion is adapted to be received within the cut-off dispensing tip of the caulking tube.

4. The replacement dispensing tip of claim 1, wherein said caulking tube includes a form-retaining sidewall, and said sharp point is adapted to pierce the sidewall at the blocked outlet end to gain access to the flowable material disposed within the caulking tube.

5. The replacement dispensing tip of claim 1, further including a central portion from which said first and second end portions extend in axial opposition.

6. The replacement dispensing tip of claim 5, wherein said central portion includes an external surface, and friction grip means formed in said external surface of said central portion.

7. A method for utilizing the usable flowable material disposed within a used caulking tube having a blocked outlet end, including the steps of:

providing a replacement dispensing tip having a sharp end, self-tapping external threads, an intake port, and a discharge opening in opposition to the sharp end, driving said sharp end into the blocked outlet end of the caulking tube, rotating the replacement dispensing tip to engage said self-tapping threads and translate the sharp point through the blockage in the blocked outlet end, whereby the intake port is brought into flow communication with the usable flowable material remaining in the caulking tube; and, exerting pressure on the usable flowable material to urge the flowable material from the caulking tube and out of the discharge opening.

8. A replacement dispensing tip, including:

a first end portion tapering to a sharp point;

threads means formed on the exterior surface of said first end portion for forming a self-tapping, self-sealing engagement;

an intake port extending into said first end portion adjacent to said sharp point;

a second end portion disposed in axial opposition to said first end portion, said second end portion tapering to an outer end, a discharge opening formed at said outer end;

an internal flow path extending from said intake port, through said first end portion and said second end portion to said discharge opening;

wherein said second end portion is severable at any selected point along the length thereof to form an outlet opening of desired size.

9. A replacement dispensing tip, including:

a first end portion tapering to a sharp point;

threads means formed on the exterior surface of said first end portion for forming a self-tapping, self-sealing engagement;

an intake port extending into said first end portion adjacent to said sharp point;

a second end portion disposed in axial opposition to said first end portion, said second end portion tapering to an outer end, a discharge opening formed at said outer end;

an internal flow path extending from said intake port, through said first end portion and said second end portion to said discharge opening;

said first end portion including a cup-like end formed integrally therein in opposition to said sharp point, said second end portion includes a cylindrical portion formed integrally therein in opposition to said discharge opening, said cup-like end and said cylindrical portion dimensioned for mutual engagement to join together said first and second end portions.

10. The replacement dispensing tip of claim 9, wherein said cup-like end includes an external surface, and friction grip means formed in said external surface of said cup-like end.

* * * * *